US005881644A

United States Patent [19]

Miyaguchi et al.

[11] Patent Number: 5,881,644

[45] Date of Patent: Mar. 16, 1999

[54] DEVICE FOR REMOVING INK APPLIED TO NON-PRINTING PARTS ON WATERLESS PLANOGRAPHIC PRINTING PLATE AND PLANOGRAPHIC PRINTING MACHINE AND METHOD USING THE SAME

[75] Inventors: Akinori Miyaguchi; Shuzaburo Kobayashi, both of Tokyo; Masayuki Iwamoto, Shizuoka-ken, all of Japan

[73] Assignee: Corporative Association "Printechno", Tokyo, Japan

[21] Appl. No.: 791,846

[22] Filed: Jan. 30, 1997

[51] Int. Cl.[6] ..... B41F 31/02

[52] U.S. Cl. ..... 101/450.1; 101/349.1

[58] Field of Search ..... 101/425, 423, 101/424, 416.1, 483, 491, 450.1, 349.1

[56] References Cited

U.S. PATENT DOCUMENTS 4,403,550 9/1983 Sharp ..... 101/451

*Primary Examiner*—Eugene Eickholt

*Attorney, Agent, or Firm*—Wenderoth, Lind & Ponack, L.L.P.

[57] ABSTRACT

Printing ink attached to non-printing parts on a waterless planographic printing plate can be removed by bringing a rotary roller having a circumferential adhesive surface coated with viscous ink having higher viscosity than that of the printing ink applied to the printing plate into contact with the printing plate in rotation. The viscous ink applied to the rotary roller is higher in viscosity than the printing ink applied to the printing plate for printing, so that the ink transferred from the printing plate to the rotary roller can be steadily captured thus the unnecessary printing ink attached to the non-printing parts on the printing plate is completely removed. Consequently, clear and sharp printed matter with print images excellently reproduced can be obtained at a low cost.

4 Claims, 3 Drawing Sheets

DEVICE FOR REMOVING INK APPLIED TO NON-PRINTING PARTS ON WATERLESS PLANOGRAPHIC PRINTING PLATE AND PLANOGRAPHIC PRINTING MACHINE AND METHOD USING THE SAME

BACKGROUND OF THE INVENTION

Field of the Invention

This invention relates to an ink removing device applicable to a printing machine using a waterless planographic printing plate, which has an excellent function of removing ink applied to non-printing parts on the waterless to planographic printing plate, so that clear and sharp printed matter with print images excellently reproduced can be obtained at a low cost. This invention further relates to a planographic printing machine provided with the aforesaid ink removing device and a planographic printing method by use of the planographic printing machine.

Description of the Prior Art

Of various sorts of printing methods which have been put to practical use, a waterless planographic printing method is easily practicable, and therefore, it is now widespread. The waterless planographic printing method will be described in rough outline, referring to FIG. 5 schematically illustrating a planographic offset printing machine. Ink in an ink fountain 50 is fed to a row of distributing rollers 52 through a ductor roller 51. This roller set 52 is generally composed of more than twenty distributing rollers, so that the ink applied and transferred to the distributing rollers in succession is spread to be made thinner to about several $\mu$ thickness. The ink is further fed from a plate cylinder 54 to a blanket cylinder 55, consequently to be transferred to a sheet of paper 57 interposed between the blanket cylinder 55 and an impression cylinder 56.

Incidentally, non-printing parts defined on the planographic printing plate applied for the waterless planographic printing method are formed of ink-repellent silicone rubber, whereas the silicone rubber is weak in ink-repellency compared with a common planographic printing plate using damping water and apt to be soiled. Accordingly, the waterless planographic printing inevitably has need for use of viscous ink which is required to be uniformly kneaded to be made thin by being transferred among lots of distributing rollers. Consequently, the printing machine turns out to be complicated and cannot be produced and maintained at a low cost.

Besides, the temperature of the distributing rollers and the printing plate in service happens to rise due to the heat which is increased when the ink is repetitiously kneaded among the distributing rollers and generated mechanically when rotating the printing cylinders. As a result, the viscosity of the ink disadvantageously becomes lower than the prescribed viscosity of the ink. When the viscosity of the ink is decreased, the ink tends to linger in spots on the non-printing parts of the printing plate, resulting in ink spot stains on the printed matter resultantly obtained.

Furthermore, in the waterless planographic printing using no damping water, the increase of heat generated on the printing plate when rotating the plate cylinder cannot be suppressed because there is no cooling means such as damping water. To overcome such shortcoming of the waterless planographic printing, attempts are being made to flow cooling water through the rollers or blow the plate cylinder with cooling air. Consequently, the printing system calls for such an expensive and complicated cooling mechanism, resulting in increased production and maintenance costs of the printing system.

OBJECT OF THE INVENTION

To eliminate the drawbacks suffered by conventional planographic printing methods as described above, this invention has an object to provide an ink removing device applicable to a waterless planographic printing machine for removing printing ink attached to non-printing parts of a waterless planographic printing plate, which can make a printing system simple in construction and low in price and produce clear and sharp printed matter with print images excellently reproduced at a low cost by use of ink which is lower in viscosity than that used for a conventional waterless planographic printing plate.

Another object of the present invention is to provide a waterless planographic printing machine using the aforementioned ink removing device for removing the ink attached to the non-printing parts of the waterless planographic printing plate.

Still another object of this invention is to provide a waterless planographic printing method using the aforesaid waterless planographic printing machine.

SUMMARY OF THE INVENTION

To attain the objects described above according to the present invention, there is provided a device for removing printing ink applied to non-printing parts of a waterless planographic printing plate, which comprises a rotary roller having a circumferential adhesive surface, which comes into contact with the waterless planographic printing plate so as to capture printing ink attached to the non-printing parts of the waterless planographic printing plate.

Onto the circumferential adhesive surface of the rotary roller, there may be applied viscous ink having higher viscosity than that of the printing ink attached to the non-printing parts of the waterless planographic printing plate.

The rotary roller may be made of synthetic rubber containing lipophilic ingredients.

A waterless planographic printing machine according to the invention incorporates the aforementioned ink removing device, so that the rotary roller comes into contact with the waterless planographic printing plate so as to capture the printing ink attached to non-printing parts of the waterless planographic printing plate while transferring the printing ink applied to the printing plate on a plate cylinder to a blanket cylinder.

In a method according to this invention, the printing ink attached to the non-printing parts of the printing plate is removed while transferring the printing ink applied to the printing plate on a plate cylinder to a blanket cylinder.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Referring to FIG. 1 through FIG. 4, one embodiment of an ink removing device according to this invention, which is adapted for removing printing ink attached to non-printing parts of a waterless planographic printing plate will be described hereinafter along with examples of a planographic printing machine provided with the ink removing device and a planographic printing method using the ink removing device according to this invention.

Figure 2:
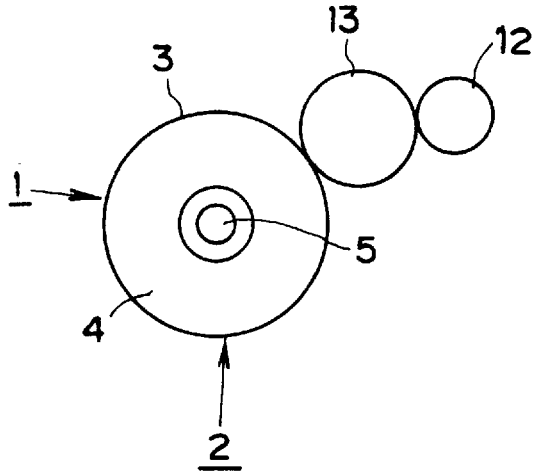
FIG. 2 is an explanatory diagram showing one process for producing a device for removing printing ink attached to non-printing parts of a waterless planographic printing plate according to this invention.

The ink removing device 1 comprises a roller 2 as shown in FIG. 2. The roller 2 is supported by a rotary shaft 5 which is rotatable about a normal direction when viewed from one end face 4. The roller 2 is made of synthetic rubber such as nitrile rubber, polychloroprene rubber and urethane rubber, which are used for rollers in a common planographic printing machine. The roller 2 has a circumferential adhesive surface 3 so as to capture printing ink attached to non-printing parts of a waterless planographic printing plate when coming into contact with the non-printing parts.

The adhesive surface 3 of the roller 2 may be formed of viscous ink having a higher viscosity than that of the printing ink which is applied to the printing plate for printing and should be removed only from the non-printing parts of the printing plate. The degree of viscosity of the viscous ink is determined in accordance with the printing ink applied to the waterless planographic printing plate for printing, but preferably to more than 12 in tack value (inkometer value at 30° C. at 400 rpm). The viscous ink may be colored or colorless, but it may be preferably of a non-drying type to stably maintain its adhesive property for a long time.

The roller 2 having such characteristics may be produced by applying viscous ink to a nip portion between a rocking roller 12 and a kneading roller 13, and rotating the rollers 12 and 13 to make the viscous ink thinner on the order of 5 $\mu$m to 10 $\mu$m, thus transferring a thin film-like ink layer to the circumferential surface 3 of the roller 2, as shown in FIG. 2 by way of example.

As another example of the roller 2 with the circumferential adhesive surface 3, the roller may be formed by adding lipophilic ingredients to synthetic rubber such as nitrile rubber, polychloroprene rubber and urethane rubber. As the lipophilic ingredients, there are vegetable oil such as flaxseed oil, china wood oil, soybean oil and castor oil which are used as carrying liquid contained in printing ink, processed oil obtained from the vegetable oil, machine oil, spindle oil, mineral oil such as light oil, and rosin, by way of example. The lipophilic content is preferably determined to be 50 to 80% by weight relative to the synthetic rubber. It is desirable to form the roller 2, containing the lipophilic ingredients, with a hardness of 30 or less, preferably 20 or less (Penetration provided under JIS K2207).

The roller 2 having such characteristics can be produced by mixing lipophilic ingredients with synthetic rubber by a common molding method.

The ink removing device according to this invention is applicable to not only waterless planographic printing, but also any conventional planographic printing using damping water.

Figure 1:
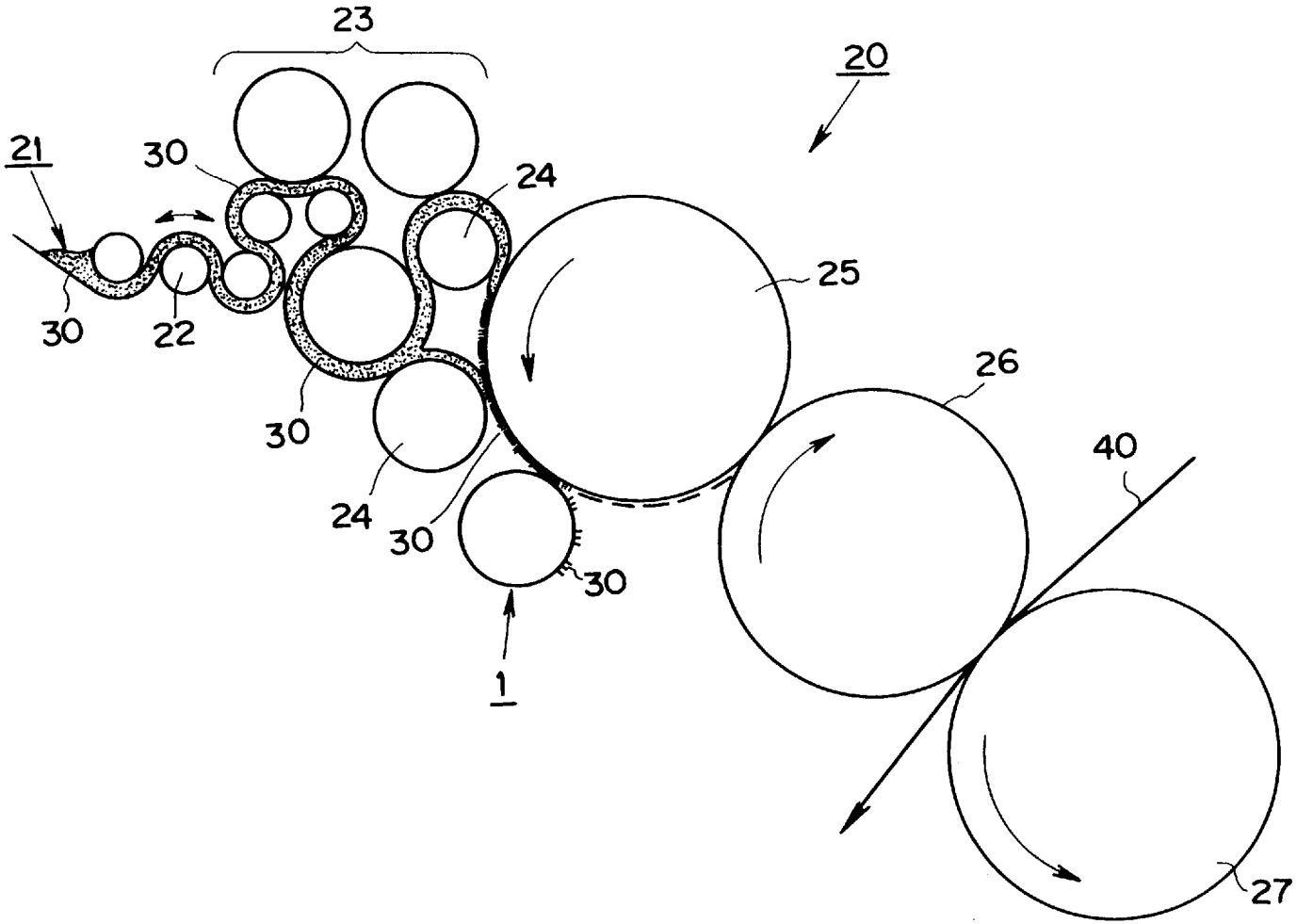
FIG. 1 is a conceptual view showing a waterless planographic printing machine according to the present invention.

A planographic printing machine 20 according to this invention includes the aforementioned ink removing device 1 as shown in FIG. 1. In the ink removing device 1 incorporated in the printing machine, the roller 2 comes into contact with the printing plate mounted on a plate cylinder 25 so as to capture ink attached to non-printing parts of the printing plate while continuously transferring the printing ink applied from the printing plate on the plate cylinder 25 to a blanket cylinder 26. The ink removing device 1 may be driven by the rotation of the plate cylinder 25, or spontaneously operate in conjunction with the plate cylinder 25.

The size of the ink removing device 1 incorporated in the planographic printing machine 20 depends on the dimension of an entire printing system and other peripheral components, but may in general be determined so that the diameter of the ink removing device 1 becomes 0.1 to 0.4 times as large as that of the plate cylinder 25.

Next, the planographic printing method adopting the planographic printing machine 20 noted above will be described. The planographic printing method is applicable to not only waterless planographic printing, but also common planographic printing using damping water. An example in which the printing method of this invention is applied to the waterless planographic printing will be described herein.

Planographic printing ink 30 in an ink fountain 21 is transferred to distributing rollers 23 through lifter rollers 22. The waterless planographic printing ink 30 is lower in viscosity than that applied for conventional planographic printing. As one example, it is desirable to use printing ink of 4.0 to 6.0 in tack value.

The waterless planographic printing ink is transferred among rollers including the distributing rollers 23, thereby turning out to be thinner in thickness. The ink is easily made thin because of its low viscosity, so that the number of distributing rollers 23 can be decreased in comparison with a conventional printing machine, as shown in FIG. 1. Since FIG. 1 shows conceptually the printing machine, the number of rollers illustrated is not always equal to that in an actual machine put to practical use, but the number of rollers in the printing machine according to this invention can be reduced to half or less of that in the conventional planographic printing machine.

Figure 3:
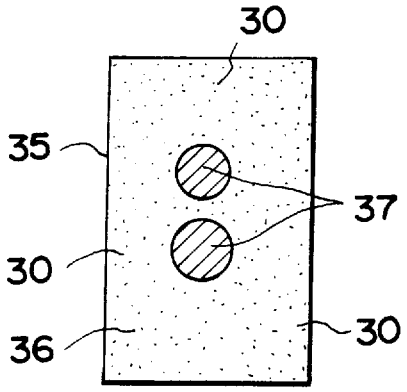
FIG. 3 is a conceptual view explanatory of a waterless planographic printing method according to this invention.
Figure 4:
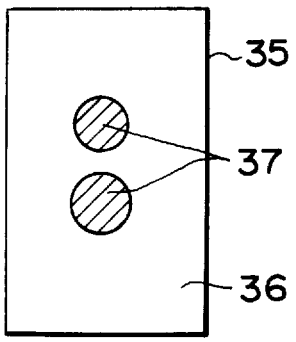
FIG. 4 is a conceptual view explanatory of the waterless planographic printing method according to this invention.

The printing ink 30 thus thinned uniformly is continuously transferred to the circumferential surface of the plate cylinder 25 which rotates in the direction shown by the arrow in FIG. 1, through form-inking rollers 24. At this time, the printing plate 35 has ink spots (ink stains) formed on the non-printing parts 36 because of the low viscosity of the printing ink 30, as shown in FIG. 3. Then, the circumferential surface 3 of the roller 2 in the ink removing device 1 comes into contact with the plate cylinder 25 in rotation on the route from the hindmost form-inking roller 24 to the blanket cylinder 26. At this time, the spots of ink 30 on the non-printing parts 36 are transferred to the circumferential surface 3 and captured by the roller 2. As a result, unnecessary ink attached to the non-printing parts 36 is wiped up and removed from the printing plate 35 mounted on the plate cylinder 25 while passing through the roller 2, but the necessary printing ink attached to the printing parts 37 is left.

The printing part 37 is receptive to ink and depressed like a dent formed in the printing plate, so that the undesired ink spot attached to the non-printing part 36 rising on the printing plate becomes higher than that attached to the depressed printing part 37. Thus, when bringing the circumferential surface 3 of the roller 2 into contact with the printing plate 35, only the undesired ink attached to the non-printing parts 36 is removed, even though the roller 2 comes in uniform contact with the whole surface of the printing plate without distinction of the printing part 37 and non-printing part 36.

As a result, the printing ink 30 left on the printing plate 35 is transferred to the blanket cylinder 26 and further to a web of paper 40 put between the blanket cylinder 26 and an impression cylinder 27. Since no ink is left on the non-printing parts 36, images are clearly reproduced on the web of paper, and resultantly, high quality printed matter can be obtained.

Next, the present invention will be made more clear upon referring to the following description about experimental examples obtained as the result of experiments performed on the method according to the invention, whereas the present invention is by no means limited only to the conditions under the experiments were conducted.

EXPERIMENTAL EXAMPLE 1

An ink removing device as shown in FIG. 1 was constructed by using a roller (6 cm diameter and 50 cm length) having its circumferential surface coated with viscous ink (Trade name "TA-MEDIUM" made by Taniguchi Ink Mfg. Co. Ltd.) having tack value of 10.

The aforesaid ink removing device was assembled in a full automatic small-sized waterless planographic printing machine (Trade name "SF-A3 MODEL" Printing Machine made by Shinohara Engineering Co. Ltd.), so that the roller is rotated with rotation of a plate cylinder in the state as shown in FIG. 1, thus forming a planographic printing machine.

The planographic printing machine described above was further provided with a waterless printing plate (Trade name "WATERLESS PLATE" made by Toray Industries, Inc.) and a waterless paper printing plate (Trade name "PR-I-Type" made by Corporative Association "PRINTECHNO"). Printing was performed with waterless planographic printing ink (Trade name "TA-GERANIUM" made by Taniguchi Ink Mfg. Co. Ltd.) having tack value of 5 at 3° C.

As a result, clear and sharp printed matter having no ink stain could be obtained, on which desired images are excellently reproduced, even after printing of 5000 sheets.

EXPERIMENTAL EXAMPLE 2

Printing of 5000 sheets was made by using the printing machine prepared in the foregoing Experimental Example 1 and planographic printing ink (Trade name "TECHNOCOLOUR WATERLESS GERANIUM" made by Taniguchi Ink Mfg. Co. Ltd.) having tack value of 5, which is commonly used with damping water. As a result, clear and sharp printed matter free from any ink stain could be obtained with excellent reproducibility, similarly to Experimental Example 1.

EXPERIMENTAL EXAMPLE 3

The ink removing device prepared in Experimental Example 1 was used for this experiment, except that the roller containing 60% mineral oil by weight was used.

This ink removing device was assembled in the printing machine used in Example 1 so as to make printing of 5000 sheets under the same conditions as in Example 1. As a result, clear and sharp printed matter having no ink stain could be obtained with excellent reproducibility, similarly to Experimental Example 1.

COMPARATIVE EXAMPLE 1

Figure 5:
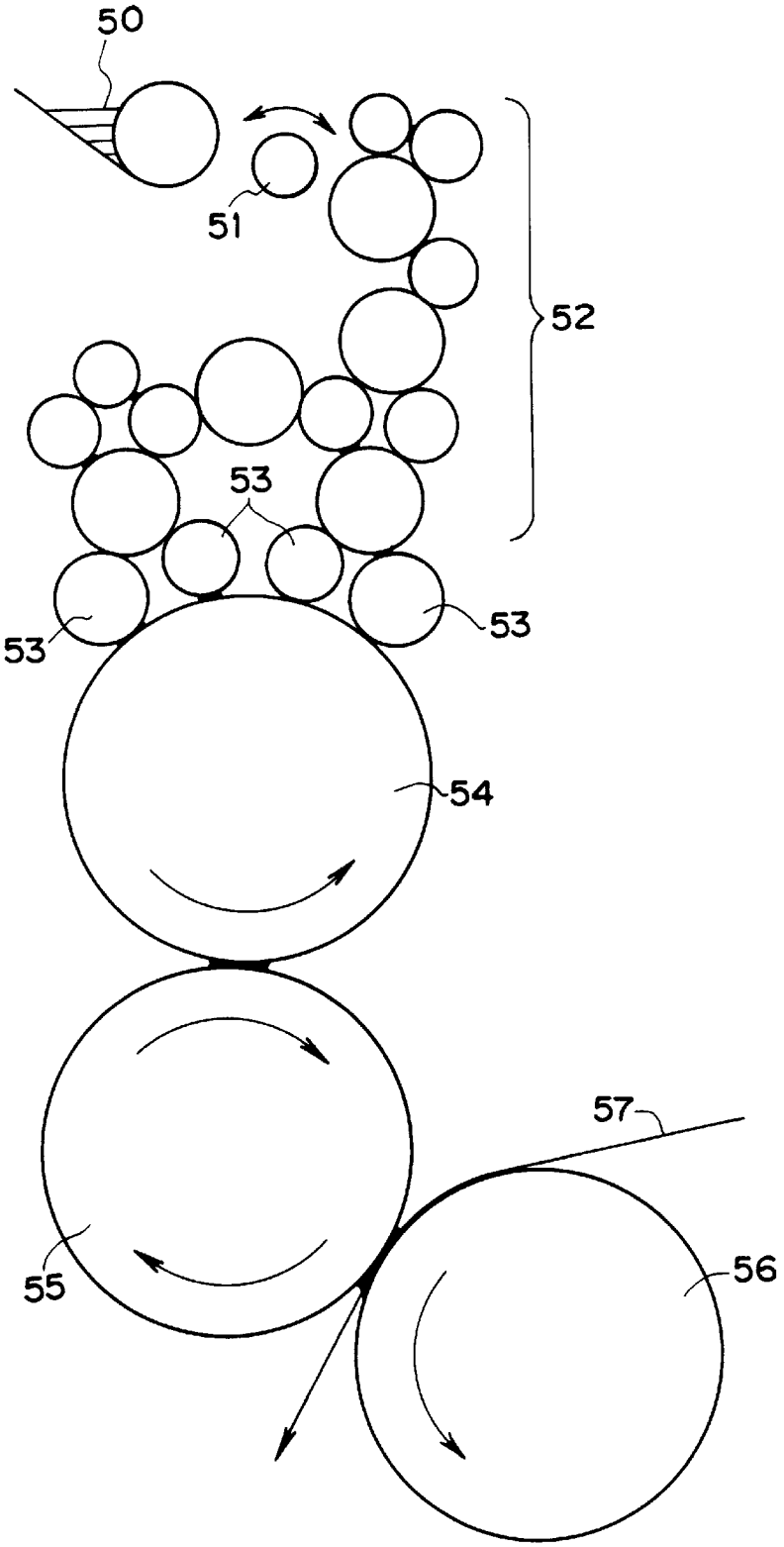
FIG. 5 is a conceptual view showing a conventional waterless planographic printing machine.

Printing was performed with waterless planographic printing ink, which has been on the market (Trade name "TECHNOCOLOUR WATERLESS GERANIUM" made by Taniguchi Ink Mfg. Co. Ltd.) and diluted to 5 in tack value, by using a conventional printing machine (Trade name "HAMADASTAR" made by Hamada Press Manufacturing Co.) incorporating a waterless printing plate (Trade name "WATERLESS PLATE" made by Toray Industries, Inc.) and a waterless printing paper plate (Trade name "PR-I-Type" made by Corporative Association "PRINTECHNO") as shown in FIG. 5 under the same conditions as Experimental Example 1 described above.

As a result, printed matter obtained even in the first printing embraced scumming stains.

As is apparent from the foregoing description, by using the ink removing device according to the present invention, printing ink attached to the non-printing parts defined on the waterless planographic printing plate can be completely removed. That is, according to the invention, printing can be well performed no matter how much printing ink is attached to the non-printing parts on the printing plate.

Accordingly, the planographic printing machine incorporating the aforesaid ink removing device makes it possible to use even printing ink of low viscosity (small tack value), which is apt to adhere to non-printing parts on a printing plate and has been so far of no practical utility for printing. Consequently, the number of distributing rollers can be decreased, and a cooling device becomes unnecessary for the printing machine. Thus, the printing machine can be made simple in spite of the fact that the ink removing device of the invention is added thereto, as a result of which the costs of production and maintenance of the printing machine can drastically be reduced.

Furthermore, the planographic printing method according to the present invention enjoys an advantage in that clear and sharp printed matter being excellent in reproducibility can be obtained in either waterless planographic printing or planographic printing using damping water.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. An ink removing device for removing printing ink applied to non-printing portions of a waterless planographic printing plate, the ink removing device comprising:

a rotary roller having a circumferential adhesive surface, said rotary roller being engageable with the waterless planographic printing plate so as to capture printing ink attached to the non-printing portions of the waterless planographic printing plate, said adhesive surface being coated with ink having a higher viscosity in relation to the printing ink attached to the non-printing parts of the waterless planographic printing plate.

2. A waterless planographic printing machine comprising:

an ink fountain, ink distributing rollers, form-inking rollers, a plate cylinder with a waterless planographic printing plate, and a blanket cylinder, wherein said ink fountain, said ink distributing rollers, said form-inking rollers, said plate cylinder, and said blanket cylinder are arranged in series so as to transfer printing ink therethrough; and a device for removing printing ink applied to non-printing parts of said waterless planographic printing plate, said ink removing device including a rotary roller having a circumferential adhesive surface in contact with said plate cylinder independently of said ink distributing rollers and said form-inking rollers, wherein said rotary roller contacts said waterless planographic printing plate so as to capture the printing ink attached to said non-printing portions of said waterless planographic printing plate while transferring the printing ink applied to said printing plate to said blanket cylinder.

3. A waterless planographic printing machine comprising:

a waterless planographic printing plate; and a device for removing printing ink applied to non-printing parts of said waterless planographic printing plate, said device including a rotary roller having a circumferential adhesive surface which is coated with ink having a higher viscosity than that of the printing ink attached to said non-printing parts of said waterless planographic printing plate, said circumferential surface being formed of synthetic rubber containing lipophilic ingredients, wherein said rotary roller contacts said waterless planographic printing plate so as to capture the printing ink attached to said non-printing parts of said waterless planographic printing plate while said printing plate is transferring the printing ink applied to printing portions of said printing plate to a blanket cylinder.

4. A method of performing waterless planographic printing by use of a waterless planographic printing machine including a device for removing printing ink applied to non-printing parts of a waterless planographic printing plate, said device including a rotary roller having a circumferential adhesive surface formed of synthetic rubber containing lipophilic ingredients, the method comprising contacting said adhesive surface of said rotary roller with said waterless planographic printing plate so as to capture the printing ink attached to said non-printing portions of said waterless planographic printing plate while transferring the printing ink, applied to said printing plate, to a blanket cylinder, and coating said circumferential surface of said rotary roller with ink having a higher viscosity than that of the printing ink attached to said non-printing parts of said waterless planographic printing plate.

* * * * *